United States Patent [19]

Boucher

[11] Patent Number: 5,032,229

[45] Date of Patent: Jul. 16, 1991

[54] DOCTORING DEVICE FOR PAPERMAKING MACHINE

[75] Inventor: Normand Boucher, Laval, Canada

[73] Assignee: Albany International Corp., Albany, N.Y.

[21] Appl. No.: 433,658

[22] Filed: Nov. 8, 1989

[51] Int. Cl.[5] ..... D21F 7/00

[52] U.S. Cl. ..... 162/281; 15/256.5; 15/256.51

[58] Field of Search ..... 162/281, 280, 286; 15/256.5, 256.51

[56] References Cited

U.S. PATENT DOCUMENTS 1,744,286 1/1930 Theile .
3,016,826 1/1962 Sage .
3,065,486 11/1962 Scott ..... 15/256.51
3,292,201 12/1966 Bedard .
3,687,730 8/1972 Murphy et al. .
4,165,965 8/1979 Bernardelli et al. ..... 15/256.51
4,616,924 10/1986 Kimura et al. ..... 15/256.51
4,768,645 9/1988 Farris .

*Primary Examiner*—David A. Simmons
*Assistant Examiner*—Thi Dang
*Attorney, Agent, or Firm*—Kane, Dalsimer, Sullivan, Kurucz, Levy, Eisele and Richard

[57] ABSTRACT

In a pulp or papermaking machine a doctor blade assembly including two doctor blades used in association with a machine roll for scraping material from the same wherein one blade is supported by a standard support member and the other blade is supported by gussets coupled to the support member with the second blade being a spaced distance from the first blade.

15 Claims, 3 Drawing Sheets

DOCTORING DEVICE FOR PAPERMAKING MACHINE

FIELD OF THE INVENTION

The present invention relates to a doctoring device for use in association with machine rolls in pulp or papermaking machines.

BACKGROUND OF THE INVENTION

Pulp or papermaking machines, utilize machine rolls. Such machine rolls are used during various aspects of the process in, for example, the press, forming, drying or calendering sections. The operation of machine rolls requires a device to remove contaminants which form on the roll surface and/or to pull off the sheet from them. A traditional method of achieving this is through the use of a mechanical device commonly referred to as a doctor or doctor blade. The failure to remove the contaminants or the sheet effectively can have a catastrophic effect on the quality of the product being produced.

The doctor blade is typically fastened to a structural beam which is adjustably supported across the papermaking machine on which a blade holder and replaceable blade is provided. The doctor blade comes in direct contact with the roll surface so as to scrape off any contaminants from the roll surface including the whole pulp or paper web sheet or parts thereof. In certain applications the material is very difficult to remove. In this regard a second doctor blade in addition to the first may be desireable to provide an added scraping factor. This allows for the roll surface to be scraped twice as much as it rotates. In addition, the space defined by the two blades provides a safe location to apply a cleaning fluid on the roll surface without contaminating or disturbing the pulp or paper web nearby.

Heretofore the means of providing two blades on the same machine roll is typically that illustrated in FIGS. 1 and 2. In FIG. 1 there is shown a machine roll 1 having two separate and independent standard doctor blade devices 2 and 3. This arrangement is quite desireable since the doctor blades may be independently adjusted with respect to the roll. Furthermore, if there is sufficient space in between the two devices each would be able to scrape the contaminants, sheet or web from the roll and deflect it away, down to a broke pit or to a safe location outside the process. In addition, such a design permits easy access for cleaning and maintenance of the blades, the blade holders and support structure. However, while such an arrangement has certain desirable features, it also has a significant drawback, that being in existing papermaking machines or in the design of new machines there simply is not enough room to install a complete and independent second doctor blade unit.

Another method of incorporating a second doctor blade on the same pulp or paper machine is shown in FIG. 2. Again a standard machine roll 4 is illustrated. To save space, a second blade 7 and blade holder 8 is added trailing the first blade 5 and blade holder 6 all of which is supported by a single solid structure 9 which may be of conventional construction. The problems with this design are many. The scrapings removed by the second blade fall back and accumulate on the support structure 9 in the closed space created in between the blades. During the operation of the machine, this area can not be cleaned and will eventually not only impede the effective operation of the blades but also it is possible that the high speed web will become stuck between the two blades and force the structure to bend away from the machine roll causing immediate damage to it.

Accordingly, there exists a need to provide for a doctor blade arrangement utilizing two doctor blades which has the advantages of the foregoing arrangements yet avoids their disadvantages.

SUMMARY OF INVENTION

It is therefore a principle object of the invention to provide for an improved doctoring device for the machine roll in a pulp or papermaking machine which is simple yet effective and which avoids the disadvantages of prior art devices.

In this regard, the present invention is directed towards providing a doctoring device which includes two doctor blades in engagement with the machine roll of a pulp or papermaking machine. The blades are placed in successive contact with the machine roll and provide a more thorough cleaning thereof. In this regard, the first doctor blade is supported by way of a typical support structure common in the industry. The second or leading doctor blade is placed ahead of the first (with respect to the direction of rotation of the machine roll) and is attached to the main structure of the first blade. The second blade is positioned by way of widely spaced gussets and the blade holder may be flexible or rigid design depending upon the application. In addition the second blade assembly is separately adjustable with respect to the first blade assembly. The maintenance and positioning of the blade arrangement provides all the advantages of two doctor blade support structures as shown in FIG. 1 without the disadvantages of the single rigid structure as shown in FIG. 2. In this regard, full adjustability of both doctor blades is realized and an opening there between is provided for the scrapings or the sheet to pass through. Also, the wide spacing provides room to place a cleaning fluid showering device if desired in addition to preventing the accumulation of dirt while providing ease of cleaning and maintenance. In case of potential malfunctioning of the leading blade, the high speed web will be removed by the second blade and can exit between the two blades, thus providing reaction time for the operator to take corrective action thereby adding a safety factor to the operation. Should however the sheet become stuck between the two blades, the leading doctor blade will be damaged first since it is the weakest. It can be removed and replaced. Furthermore, the machine will still be operational with the leading blade removed since the first blade remains providing for standard one blade operation.

BRIEF DESCRIPTION OF THE DRAWINGS

Thus the objects and advantages of the invention will be realized, the description of which should be taken in conjunction with a view of the drawings wherein.

DETAILED DESCRIPTION OF THE PREFERRED EMBODIMENT

Figure 1:
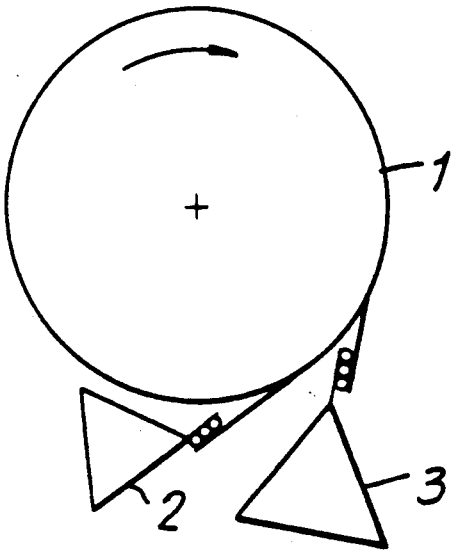
FIG. 1 PRIOR ART
FIGS. 1 and 2 depict prior art arrangements previously discussed.
Figure 2:
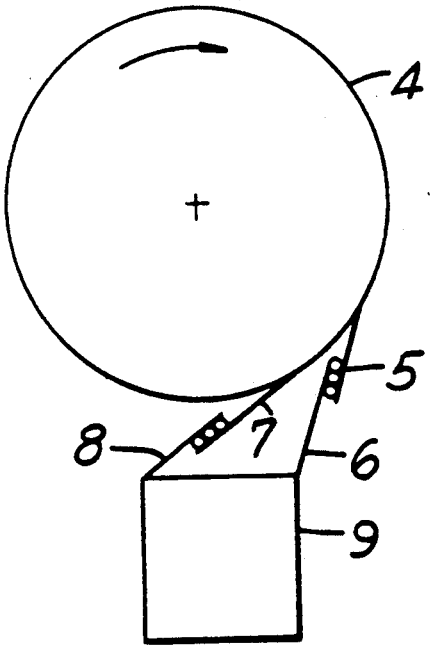
FIG. 2 PRIOR ART
Figure 3:
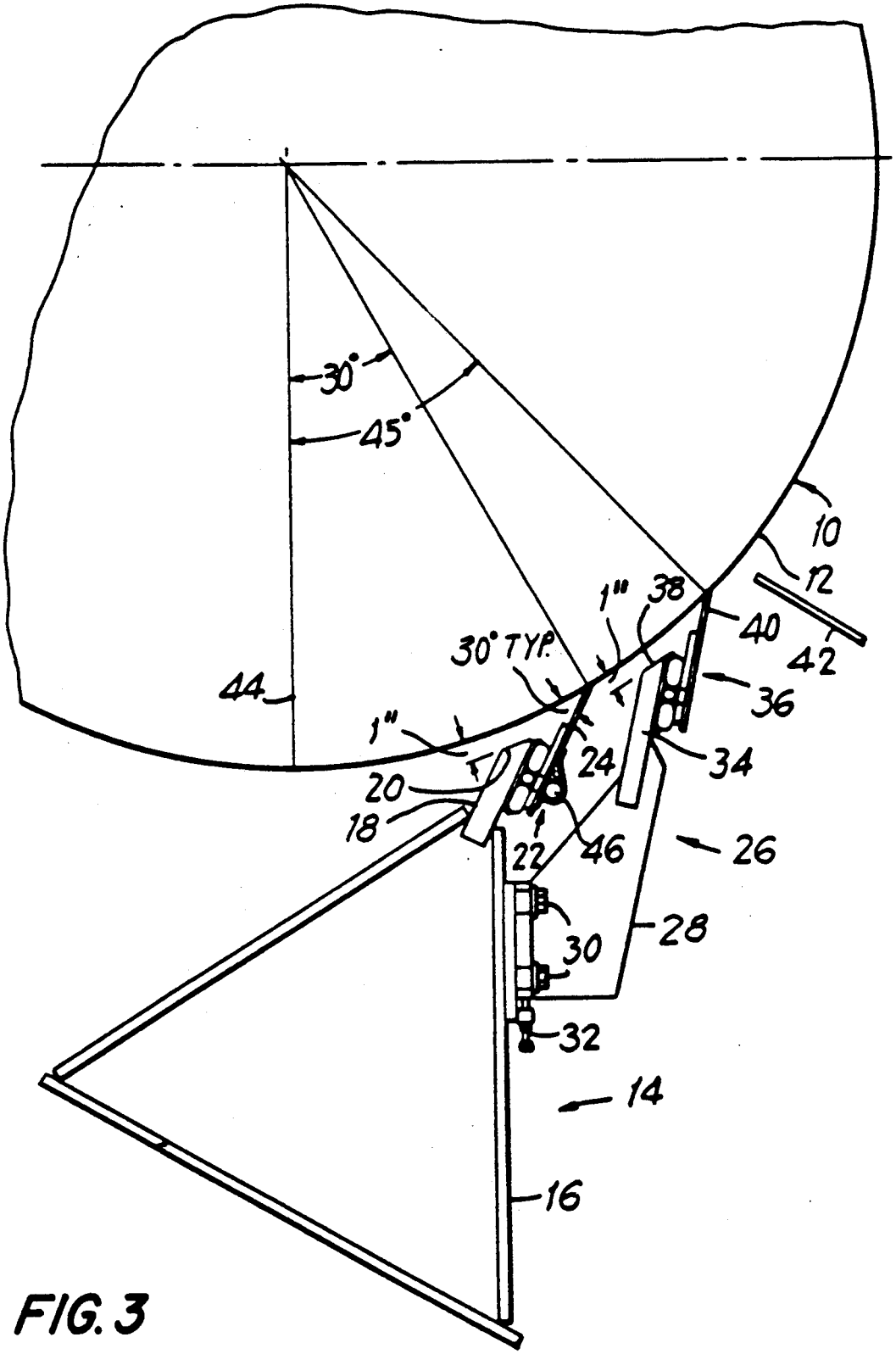
FIG. 3 depicts a somewhat schematic side view of the two blade doctor arrangement incorporating the teachings of the present invention.
Figure 4:
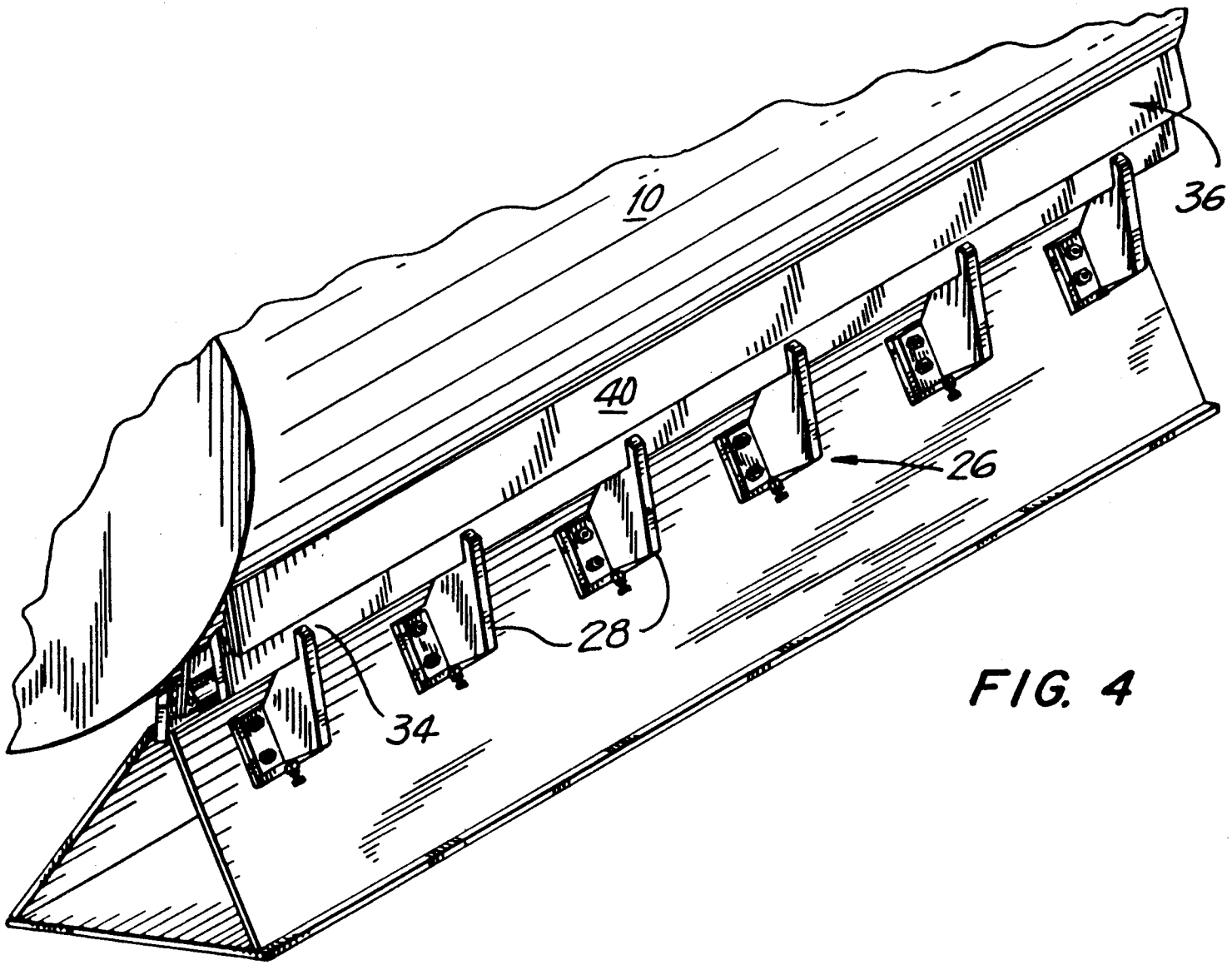
FIG. 4 is an isometric view of the two doctor blade arrangement showing the supporting members for the second doctor blade, incorporating the teachings of the present invention.

Turning now more particularly to FIGS. 3 and 4, there is shown a portion of a machine roll 10 used in a pulp or papermaking machine. This machine roll 10 may be that used in for example the press, forming, drying or calendering sections of a pulp or papermaking machine or with other machine rolls used in the process. The machine roll 10 may be cylindrical, crowned or of other configuration suitable for purpose having an outer surface 12 which may be smooth, rough (i.e. granite which is relatively rough) etc., depending upon the application in which it is being used. The machine roll 10 in FIG. 3 would be rotating in a clockwise direction.

Positioned adjacent the roll 10 is the doctor blade assembly, generally indicated by the numeral 14. The assembly 14 comprises a main support structure 16 which may be of typical construction common in the industry. The support structure 16 serves to support the doctor blades which are in contact with surface 12 along the length of the roll 10, as will be discussed.

In this regard, coupled to structure 14 is a plate 18 which runs across the pulp and paper machine adjacent roll 10. Plate 18 terminates at an angled surface 20 which is positioned approximately 1 inch from surface 12 of the machine roll 10.

Mounted on plate 18 is a doctor blade holder 22 which serves to support a detachable doctor blade 24. The doctor blade 24 and holder 22 may be of the type commonly used in the industry. This may for example be of the type manufactured by Albany International, Corp. assignee herein Model No. KF-35, KF-35A or PNEUFLEX® which can be of rigid or flexible design depending upon application. Doctor blade 24 is removable and therefore replaceable when worn out. The position of support 16 is adjustable in relation to roll 10 to adjust the position of blade 24. Holder 22 may be adjustable in nature to further adjust the position of blade 24 and to properly bias it with respect to the roll 10. Doctor blade 24 is shown engaging the surface 12 at approximately a 30° angle thereto and runs the length of the roll 10. This angle can vary considerably depending upon the needs of the particular application.

A leading edge doctor blade assembly 26 is provided upstream of blade 24. This assembly 26 includes widely spaced gussets 28 (one shown) mounted along support structure 16 (for example on the order of 48") via mounting bolts 30 which allow the removal of the assembly 26 for repair or replacement or the shimming of assembly 26. The mounting arrangement may include slots in the gussets 28 and an accompanying jack screw assembly 32 to further adjust its position.

Coupled to the gussets 28 is a support plate 34 which supports a second doctor blade holder 36. Plate 34 similarly terminates at an angled surface 38 positioned approximately 1 inch from surface 12. Doctor blade holder 36 serves to support the second doctor blade 40 which is detachable therefrom for repair or replacement. Again blade 40 and holder 36 as aforesaid may be of the type commonly used in the industry. Holder 36 may be adjustable in nature to further adjust the position of blade 40 and properly bias it. The blade 40 is shown engaging surface 12 at an angle of 30° and runs the length of the roll 10. The angle of contact again can vary considerably depending on the application involved. In addition, for the scraping off of the sheet from the roll, sheet slitters which may be high pressure jets, generally indicated by numeral 42, that slit the sheet ahead of the gussets may be incorporated possibly mounted on or adjacent or ahead of the gussets 28 and/or support plate 34 or at any other location suitable for purpose.

The relative position of the blades 24 and 40 is shown just by way of example at respective angles of 30° and 45° (15° apart) with respect to perpendicular line 44 other angular placement may of course be utilized depending upon the particular application as long as sufficient spacing is achieved between the blades (i.e. 6"–12"). This serves to illustrate the spacing between the blades which provides ample room to allow the scraped material to fall through or the sheet to pass therebetween. This not only prevents the accumulation of dirt but also allows the positioning of a cleaning fluid showering device if so desired. Such a showering device 46 may be mounted on blade holder 22 and includes a feed pipe having a plurality of nozzles for spraying the roll 10 which not only assists in the removal of the scrapings (which are generally sticky) but also serves to lubricate the roll 10. Such spraying further allows for easy maintenance. Should for some reason the second blade assembly 26 become damaged it can be removed and replaced. Should replacement be delayed, the pulp or paper machine could still operate with the single standard doctor blade.

Thus by the present invention, its objects and advantages are realized and although a preferred embodiment has been disclosed and described in detail herein, its scope should not be limited thereby rather its scope should be determined by that of the appended claims.

What is claimed is:

1. In a pulp or papermaking machine having a machine roll, a doctor blade assembly comprising:

principal doctor blade means engagable with the machine roll for scraping material therefrom as the machine roll rotates;

principal support means positioned adjacent the machine roll and supporting the principal doctor blade means;

secondary doctor blade means positioned upstream of the principal doctor blade means with respect to the direction of the rotation of the machine roll at a spaced distance from the principal doctor blade means to allow for scraped material to pass therebetween and beyond the support means, said secondary doctor blade means being supported by spacing means couple to said support means; said spacing means comprising a plurality of support members spaced along the length of the secondary doctor blade means with said spacing means being so constructed so as to allow the passing of the scraped material beyond the support means; and wherein the position of said principal doctor blade means and secondary doctor blade means are spaced to allow for an open space therebetween for the passing of the scraped material therethrough and beyond the support means so as not to collect thereon or otherwise interfere with the operation of the doctor blade means.

2. The invention in accordance with claim 1 wherein said doctor blades means are disposed at a predetermined angle with respect to the machine roll.

3. The invention in accordance with claim 2 wherein said doctor blades means are spaced at approximately 6"–12" apart.

4. The invention in accordance with claim 3 which includes a sheet slitter means aligned with spacing means to split a web allowing said web to pass thereby.

5. The invention in accordance with claim 4 which includes showering means positioned in the open space between said doctor blade means.

6. The invention in accordance with claim 1 which includes a sheet slitter means aligned with spacing means to split a web allowing said web to pass thereby.

7. The invention in accordance with claim 1 which includes showering means positioned in the open space between said doctor blade means.

8. The invention in accordance with claim 1 wherein at least one of said doctor blade means is supported by a rigid blade holder.

9. The invention in accordance with claim 1 wherein at least one of said doctor blade means is supported by a flexible blade holder.

10. The invention in accordance with claim 1 wherein said pulp or papermaking machine includes a press section and the machine roll is located in said press section.

11. The invention in accordance with claim 1 wherein said pulp or papermaking machine includes a forming section and the machine roll is located in said forming section.

12. The invention in accordance with claim 1 wherein said pulp or papermaking machine includes a drying section and the machine roll is located in said drying section.

13. The invention in accordance with claim 1 wherein said pulp or papermaking machine includes a calendering section and the machine roll is located in said calendering section.

14. The invention in accordance with claim 4 wherein the support members comprise gussets detachably coupled to the support means.

15. The invention in accordance with claim 1 wherein the support members comprise widely spaced gussets detachably coupled to the support means.

* * * * *